US012305668B2

(12) United States Patent
Okamoto et al.

(10) Patent No.: US 12,305,668 B2
(45) Date of Patent: May 20, 2025

(54) CENTRIFUGAL COMPRESSOR

(71) Applicants: TOYOTA JIDOSHA KABUSHIKI KAISHA, Toyota (JP); IHI CORPORATION, Tokyo (JP)

(72) Inventors: Hiroyuki Okamoto, Seto (JP); Masaya Tagawa, Toyota (JP); Takato Hatano, Seto (JP); Shigehiro Usuda, Miyoshi (JP); Yusei Ogawa, Koto-ku (JP); Toshifumi Terui, Koto-ku (JP); Shohei Sato, Koto-ku (JP)

(73) Assignees: TOYOTA JIDOSHA KABUSHIKI KAISHA, Toyota (JP); IHI CORPORATION, Tokyo (JP)

( * ) Notice: Subject to any disclaimer, the term of this patent is extended or adjusted under 35 U.S.C. 154(b) by 0 days.

(21) Appl. No.: 18/808,157

(22) Filed: Aug. 19, 2024

(65) Prior Publication Data

US 2025/0092883 A1 Mar. 20, 2025

(30) Foreign Application Priority Data

Sep. 14, 2023 (JP) ..... 2023-149367

(51) Int. Cl.
*F04D 29/42* (2006.01)
*F04D 17/10* (2006.01)
*F04D 29/68* (2006.01)

(52) U.S. Cl.
CPC ..... *F04D 29/685* (2013.01); *F04D 17/10* (2013.01); *F04D 29/4213* (2013.01)

(58) Field of Classification Search
CPC ..... F04D 29/685; F04D 29/06
See application file for complete search history.

(56) References Cited

U.S. PATENT DOCUMENTS 10,774,676 B2 * 9/2020 Hu ..... F01D 17/165
10,954,960 B2 * 3/2021 Wang ..... F04D 29/462
2022/0325631 A1 10/2022 Ramb et al.

FOREIGN PATENT DOCUMENTS

JP 2009-264339 A 11/2009
JP 2022-161035 A 10/2022

* cited by examiner

*Primary Examiner* — Sabbir Hasan
(74) *Attorney, Agent, or Firm* — Oblon, McClelland, Maier & Neustadt, L.L.P.

(57) ABSTRACT

A centrifugal compressor includes a compressor housing accommodating an impeller, and a casing treatment. The compressor housing include an air introduction hole through which air is introduced toward the impeller, an annular portion disposed inside the air introduction hole, and spoke portions. Each of the spoke portions connects an inner circumferential wall surface of the air introduction hole and the annular portion. The casing treatment includes a tubular portion provided on an upstream side of the annular portion in the air introduction hole in an introduction direction of the air, and wing-like portions. Each of the wing-like portions extends from the tubular portion toward a downstream side in the introduction direction of the air.

3 Claims, 9 Drawing Sheets

CENTRIFUGAL COMPRESSOR

CROSS-REFERENCE TO RELATED APPLICATION

This application is based upon and claims the benefit of priority of the prior Japanese Patent Application No. 2023-149367, filed on Sep. 14, 2023, the entire contents of which are incorporated herein by reference.

TECHNICAL FIELD

The present disclosure relates to a centrifugal compressor.

BACKGROUND

Conventionally, a turbocharger provided with a casing treatment is known. The casing treatment forms a sub flow path which branches from a main flow path for sucking air into the centrifugal compressor and joins the main flow path again (see, for example, Japanese Unexamined Patent Application Publication No. 2009-264339).

The casing treatment increases the apparent flow rate of air by recirculating air sucked into the centrifugal compressor. Thus, the torque in the low rotation region of the turbocharger is improved. On the other hand, however, the turbocharger provided with the casing treatment generates high-frequency airflow noise accompanying the intake of air in a high rotation speed range. In a turbocharger mounted on a vehicle, it is desirable that airflow noise is small. Japanese Unexamined Patent Application Publication No. 2009-264339 does not propose to reduce the volume of the airflow sound.

SUMMARY

It is therefore an object of the present disclosure to reduce a volume of airflow noise in a centrifugal compressor including a casing treatment.

The above object is achieved by a centrifugal compressor including: a compressor housing accommodating an impeller; and a casing treatment, wherein the compressor housing includes: an air introduction hole through which air is introduced toward the impeller; an annular portion disposed inside the air introduction hole; and spoke portions, each of the spoke portions connecting an inner circumferential wall surface of the air introduction hole and the annular portion, the casing treatment includes: a tubular portion provided on an upstream side of the annular portion in the air introduction hole in an introduction direction of the air; and wing-like portions, each of the wing-like portions extending from the tubular portion toward a downstream side in the introduction direction of the air; in the casing treatment, an inside of the tubular portion forms a main flow path of the air, and the wing-like portion engages with the annular portion to form a sub flow path, the sub flow path branches from the main flow path and joins the main flow path again together with the annular portion and the spoke portion, the number of the spoke portions is equal to the number of the wing-like portions, and the spoke portions and the wing-like portions are arranged at same positions in a circumferential direction of the annular portion, respectively.

A thickness dimension of the wing-like portion along the circumferential direction of the annular portion may be equal to or less than a thickness dimension of the spoke portion along the circumferential direction of the annular portion.

DETAILED DESCRIPTION

Figure 1:
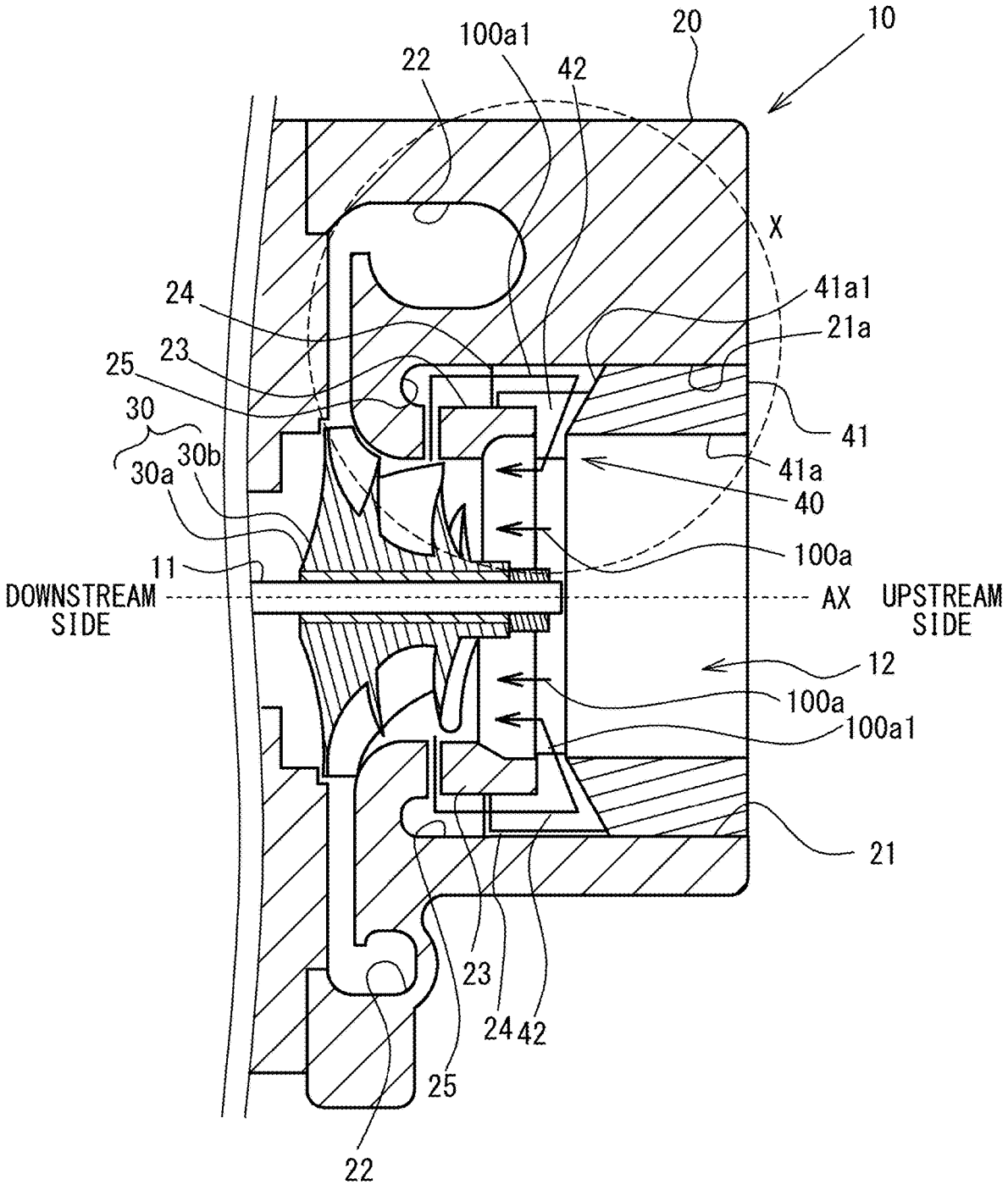
FIG. 1 is a cross-sectional view of a centrifugal compressor according to an embodiment along an axis AX.

Hereinafter, embodiments of the present disclosure will be described with reference to the accompanying drawings. However, in the drawings, the dimensions, ratios, and the like of the respective parts may not be illustrated so as to completely match the actual ones. In some drawings, details may be omitted.

Embodiment

[Centrifugal Compressor]

A centrifugal compressor 10 according to the present embodiment constitutes a part of a turbocharger. The turbocharger includes a turbine unit and the centrifugal compressor 10. The turbine unit and the centrifugal compressor 10 are connected by a connection unit. The Turbocharger is incorporated into an internal combustion engine. The turbine unit is located in an exhaust flow path, and the centrifugal compressor 10 is located in an intake flow path. FIG. 1 illustrates only the centrifugal compressor 10. The centrifugal compressor 10 includes a compressor housing 20 and an impeller 30.

[Compressor Housing]

The compressor housing 20 accommodates the impeller 30 therein. The compressor housing 20 includes an air introduction hole 21 that introduces air toward the impeller 30. The compressor housing 20 includes a scroll flow path 22 that compresses air introduced toward the impeller 30. The scroll flow path 22 is formed on the radially outer side of the impeller 30. The compressor housing 20 includes an annular portion 23 disposed inside the air introduction hole 21.

The annular portion 23 is disposed on the upstream side of the impeller 30 in the air introduction direction. The annular portion 23 is connected to an inner circumferential wall surface 21*a* of the air introduction hole 21 via spoke portions 24. A space is formed around the annular portion 23 supported by the spoke portions 24. This space forms a sub flow path 25 for circulating air. The sub flow path 25 will be described in detail later.

The spoke portions 24 are provided. The spoke portions 24 are arranged at equal intervals along the circumferential direction of the annular portion 23. For example, when the number of the spoke portions 24 is two, the spoke portions 24 are arranged at positions spaced apart from each other by 180 degrees in the circumferential direction. When the number of the spoke portions 24 is three, the spoke portions 24 are arranged at positions spaced apart from each other by 120 degrees in the circumferential direction. When the number of the spoke portions 24 is four, the spoke portions 24 are arranged at positions spaced apart from each other by 90 degrees in the circumferential direction. When the number of the spoke portions 24 is five, the spoke portions 24 are arranged at positions spaced apart from each other by 72 degrees in the circumferential direction. When the number of the spoke portions 24 is six, the spoke portions 24 are arranged at positions spaced apart from each other by 60 degrees in the circumferential direction.

Figure 4A:
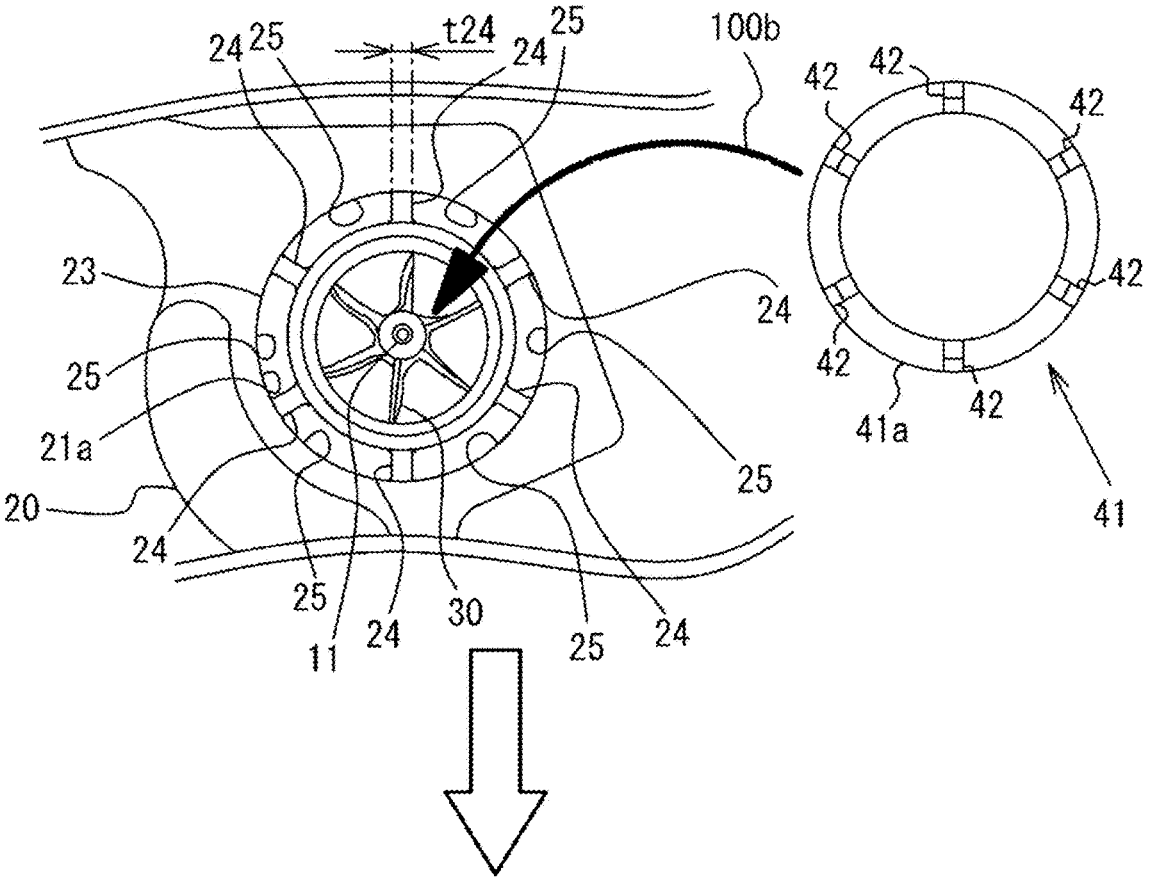
FIGS. 4A and 4B are views schematically illustrating a state in which the insert ring is mounted in an air introduction hole formed in a compressor housing.
Figure 4B:
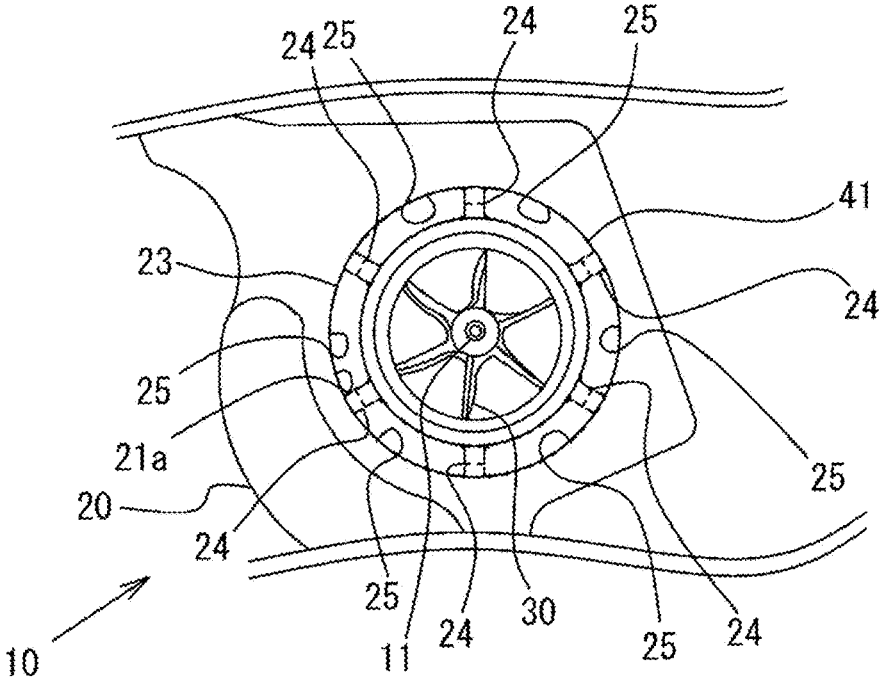

The number of the spoke portions 24 is not limited to these. The number of the spoke portions 24 in the present embodiment is six as illustrated in FIGS. 4A and 4B. The spoke portion 24 has a t24 along the circumferential direction of the annular portion 23 as illustrated in FIG. 4A. The spoke portions 24 do not necessarily have to be arranged at equal intervals.

[Impeller]

The impeller 30 is provided at one end of a rotary shaft member 11. The impeller 30 includes a mounting portion 30*a* having a tubular shape and impeller blades 30*b* formed around the mounting portion 30*a*. The impeller 30 is integrated with the rotary shaft member 11 by fixing the mounting portion 30*a* to the rotary shaft member 11. Although not illustrated, a turbine rotor having turbine blades is provided on the other end side of the rotary shaft member 11. The turbine rotor is accommodated in a turbine housing and forms a turbine unit together with the turbine housing. A coupling unit for coupling the turbine unit and the centrifugal compressor 10 is provided therebetween. The coupling unit is provided with a bearing portion. The bearing portion rotatably supports the rotary shaft member 11.

[Casing Treatment]

Figure 3A:
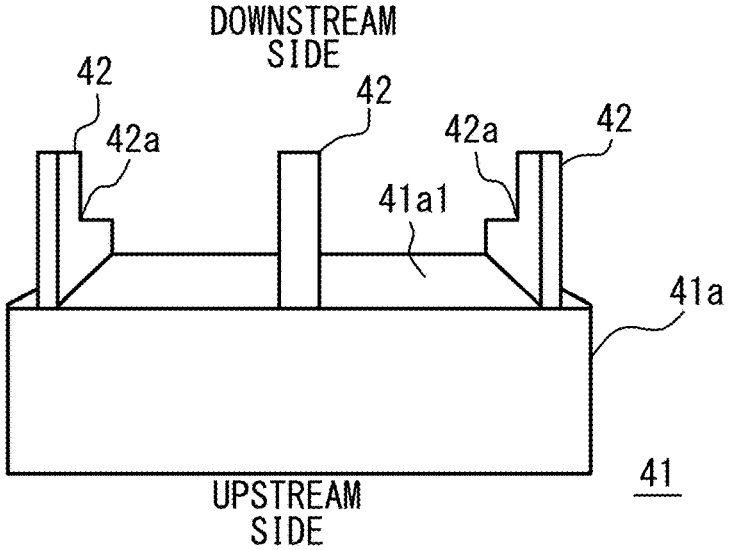
FIG. 3A is a side view of an insert ring.
Figure 3B:
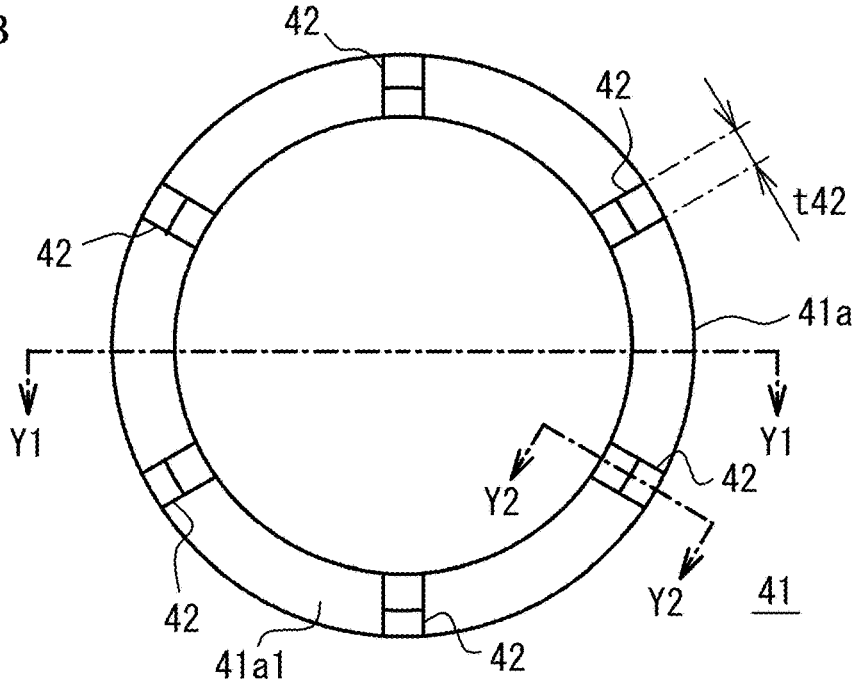
FIG. 3B is a plan view of the insert ring.
Figure 3C:
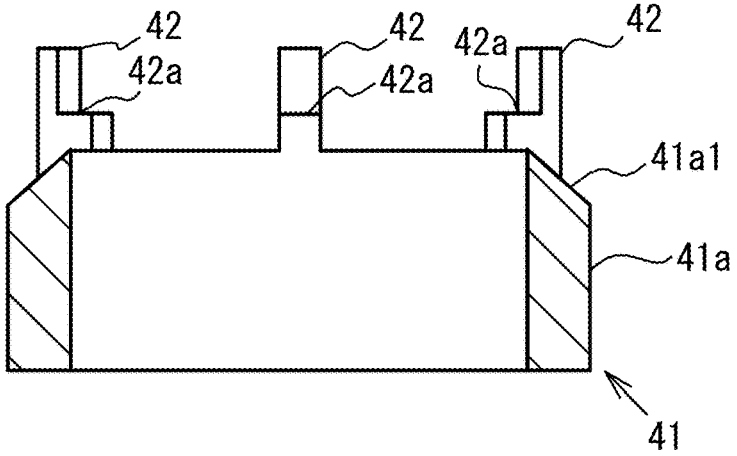
FIG. 3C is a cross-sectional view taken along line Y1-Y1 in FIG. 3B.

Next, a casing treatment 40 will be described. The casing treatment 40 forms the sub flow path 25. The sub flow path 25 branches from a main flow path 12 for the air introduced into the centrifugal compressor 10 and joins the main flow path 12 again. The casing treatment 40 is formed by fitting an insert ring 41 into the air introduction hole 21 formed in the compressor housing 20. As illustrated in FIGS. 3A and 3B, the insert ring 41 includes a tubular portion 41*a* and a plurality of wing-like portions 42. The insert ring 41 is mounted in the air introduction hole 21 of the compressor housing 20 such that the upstream side illustrated in FIG. 3A coincides with the upstream side illustrated in FIG. 1. Note that FIG. 3B is a plan view of the insert ring 41, and illustrates a state of the insert ring 41 as viewed from the downstream side illustrated in FIG. 3A. FIG. 3C is a cross-sectional view taken along line Y1-Y1 in FIG. 3B.

An axial direction of the tubular portion 41*a* coincides with an axis AX of the rotary shaft member 11. The tubular portion 41*a* includes an inclined surface 41*a*1 at a peripheral edge portion located on the downstream side in the air introduction direction. The inclined surface 41*a*1 is inclined upward from the radially outer side of the tubular portion 41*a* toward the radially inner side thereof in the side view illustrated in FIG. 3A. The wing-like portion 42 is provided so as to protrude from the inclined surface 41*a*1 toward the downstream side in the air introduction direction. The wing-like portion 42 has a plate shape. The wing-like portion 42 is provided on the inclined surface 41*a*1 so that the thickness direction of the wing-like portion 42 substantially coincides with the circumferential direction of the tubular portion 41*a*. The wing-like portion 42 has a shape in which the size in the direction along the air introduction direction is different between a portion located on the radially outer side of the tubular portion 41*a* and a portion located on the radially inner side of the tubular portion 41*a*. In the wing-like portion 42, the size of the portion located radially outside the tubular portion 41*a* along the air introduction direction is longer than the size of the portion located radially inside the tubular portion 41*a* along the air introduction direction. Thus, the wing-like portion 42 is provided with a cutout portion 42*a* formed by cutting out the radially inner portion of the tubular portion 41*a*.

The thickness dimension of the wing-like portion 42 substantially along the circumferential direction of the tubular portion 41*a* is indicated by t42 as illustrated in FIG. 3B. The circumferential direction of the tubular portion 41*a* coincides with the circumferential direction of the annular portion 23 when the casing treatment 40 is mounted on the compressor housing 20. The thickness dimension t42 of the wing-like portion 42 is equal to or less than the thickness dimension t24 of the spoke portion 24. This suppresses vortex generation. In the present embodiment, the thicknesses t42 of the wing-like portion 42 and the thicknesses t24 of the spoke portion 24 are equal to each other.

The number of the wing-like portions 42 is the same as the number of the spoke portions 24. The positions of the wing-like portions 42 along the circumferential direction of the annular portion 23 are the same as the positions of the spoke portions 24 along the circumferential direction of the annular portion 23. The number of the spoke portions 24 in the present embodiment is six. Therefore, the number of the wing-like portions 42 in the present embodiment is six. The wing-like portions 42 are arranged at positions separated by 60 degrees in the circumferential direction, similarly to the spoke portions 24. The spoke portions 24 may not be arranged at equal intervals. Even in this case, the arrangement position of the wing-like portion 42 along the circumferential direction of the annular portion 23 may be the same as the arrangement position of the spoke portion 24 along the circumferential direction of the annular portion 23.

The insert ring 41 is press-fitted into the air introduction hole 21 of the compressor housing 20 as indicated by an arrow 100*b* in FIG. 4A. In this case, the insert ring 41 is fitted into the air introduction hole 21 so that the wing-like portion 42 is positioned on the downstream side in the air introduction direction.

Figure 5:
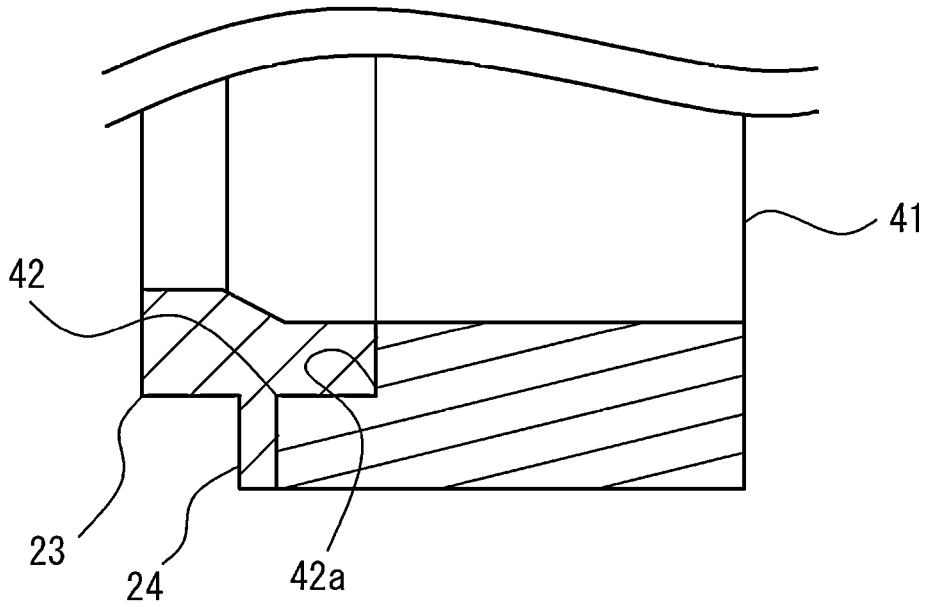
FIG. 5 is an enlarged sectional view of a connecting portion between a spoke portion and a wing-like portion taken along a line Y2-Y2 in FIG. 3B.

In this case, the arrangement position of each wing-like portion 42 along the circumferential direction of the annular portion 23 is matched with the arrangement position of each spoke portion 24 along the circumferential direction of the annular portion 23. That is, the insert ring 41 is fitted into the air introduction hole 21 so that the phase positions of the wing-like portions 42 and the spoke portions 24 in the circumferential direction coincide with each other. As a result, as illustrated in FIG. 5, the cutout portion 42*a* of the wing-like portion 42 is engaged with the spoke portion 24. As for the state in which the arrangement position of the spoke portion 24 and the arrangement position of the wing-like portion 42 coincide with each other, design values have only to coincide with each other. For example, a slight misalignment may be observed in the product. However, if the misalignment is caused by the machining accuracy or the assembly accuracy of each part, the arrangement position of the spoke portion 24 and the arrangement position of the wing-like portion 42 coincide with each other and are regarded as the same position.

The spoke portion 24 and the wing-like portion 42 joined to each other function as a partition portion that divides the sub flow path 25 along the circumferential direction. Therefore, a plurality of sub flow paths 25 are formed along the circumferential direction. The spoke portions 24 and the wing-like portions 42 are arranged at equal intervals along the circumferential direction of the annular portion 23. Therefore, each circumferential length of the sub flow paths 25 is the same.

As described above, the thicknesses dimension t42 of the wing-like portion 42 is equal to the thicknesses dimension t24 of the spoke portion 24. Therefore, the wing-like portion 42 and the spoke portion 24 are flush with each other at the joint portion.

Figure 2:
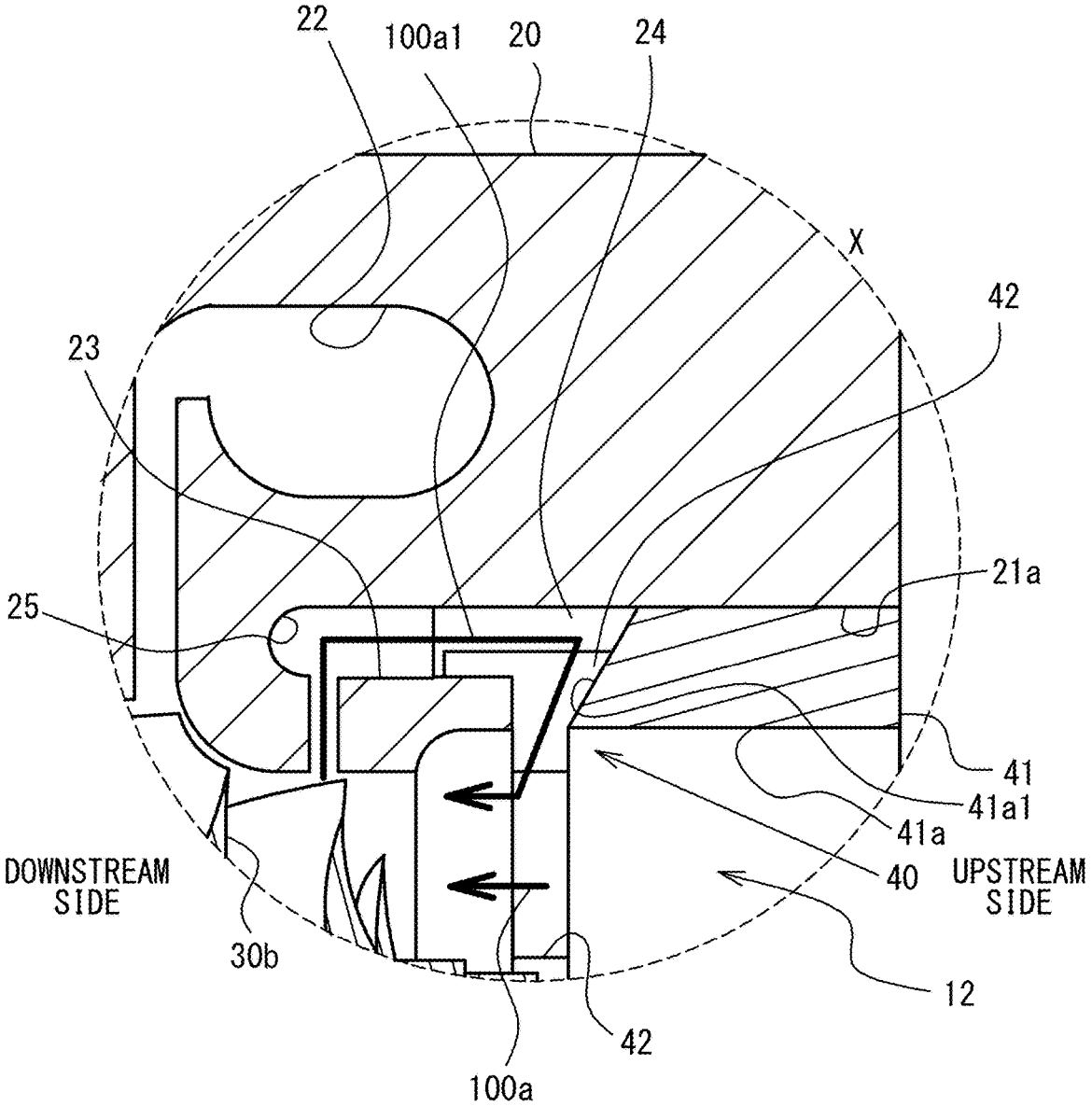
FIG. 2 is an enlarged view of a portion X in FIG. 1.

The insert ring 41 is fitted into the air introduction hole 21, and thus the inside of the tubular portion 41*a* of the insert ring 41 forms a part of the main flow path 12. The insert ring 41 fitted into the air introduction hole 21 forms the sub flow path 25 together with the annular portion 23 and the spoke portions 24. In FIGS. 1 and 2, the air passing through the main flow path 12 is indicated by an arrow 100*a*. A part of the air passing through the main flow path 12 is branched to the sub flow path 25 and joins the main flow path 12 as illustrated by an arrow 100*a*1. This increases the apparent flow rate of air sucked into the centrifugal compressor 10.

As illustrated in FIG. 2, a part of the air passing through the main flow path 12 flows toward the radially outer side of the annular portion 23 on the downstream side of the annular portion 23. Then, the air flows toward the inclined surface 41*a*1 of the tubular portion 41*a* in the sub flow path 25. The air that has collided with the inclined surface 41*a*1 flows toward the inside of the annular portion 23. The air that has flowed toward the inside of the annular portion 23 merges with the main flow path 12 and flows through the main flow path 12 again.

The separation and vortex of the airflow circulating in the sub flow path 25 might increase the volume of the airflow sound. The centrifugal compressor 10 according to the present embodiment suppresses separation of the airflow, and reduces the vorticity of the flow field, that is, the strength of the vortex.

The number of the spoke portions 24 forming the plurality of sub flow paths 25 is the same as the number of the wing-like portions 42. The circumferential arrangement position of the spoke portion 24 and the circumferential arrangement position of the wing-like portion 42 are the same. Thus, the inner peripheral surface of the sub flow path 25 is formed smoothly without forming irregularities inside the sub flow path 25. This suppresses airflow separation and reduces the vorticity of the flow field. As a result, the increase in the volume of the airflow noise of the air flowing into the sub flow path 25 and merging with the main flow path 12 is suppressed, and the airflow noise is reduced.

[Airflow Noise]

Figure 6:
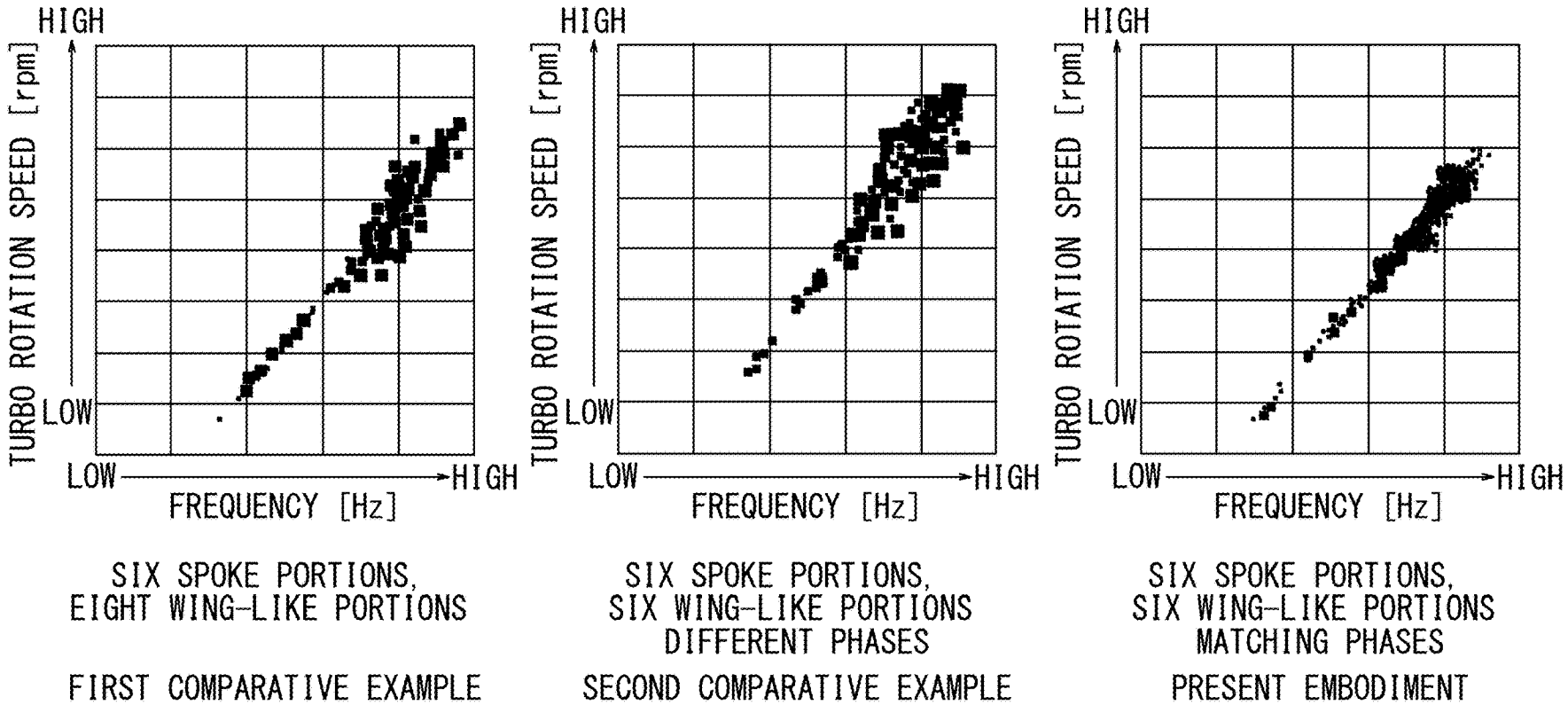
FIG. 6 is a graph illustrating a volume of airflow noise in the centrifugal compressor according to the embodiment and volumes of airflow noise in centrifugal compressors of comparative examples.

FIG. 6 illustrates a graph illustrating a volume of airflow noise in the centrifugal compressor 10 according to the embodiment and volumes of airflow noise in centrifugal compressors of comparative examples. In each graph, the vertical axis represents turbo rotation speed [rpm]. The horizontal axis represents frequency [Hz]. The volume of the airflow sound is indicated by the size of the plotted points. That is, the larger the size of the point plotted on each graph, the larger the airflow noise.

A first comparative example includes six spoke portions and eight wing-like portions. Therefore, the arrangement position of the spoke portion and the arrangement position of the wing-like portion are misaligned. As a result, irregularities exist in the sub flow path. The airflow is considered to be separated at the irregularities in the sub flow path. As a result, the volume of the airflow noise in the first comparative example is large.

A second comparative example includes six spoke portions and six wing-like portions. That is, the spoke portions and the wing-like portions are the same in number. However, the arrangement position of the spoke portion along the circumferential direction is different from the arrangement position of the wing-like portion 42 along the circumferential direction. When the phases of the spoke portion and the wing-like portion do not match, a vortex might be generated when the air passes through the inside of the sub flow path, and the airflow noise might increase. As a result, the volume of the airflow noise in the second comparative example is large.

In contrast, the number of the spoke portions 24 and the number of the wing-like portions 42 in the present embodiment are the same. The spoke portions 24 and the wing-like portions 42 are arranged at the same positions in the circumferential direction. Thus, the volume of the airflow noise in the present embodiment is smaller than those in the first comparative example and the second comparative example.

In the centrifugal compressor 10 according to the present embodiment, the number of the spoke portions 24 is the same as the number of the wing-like portions 42. The spoke portions 24 are arranged at the same positions along the circumferential direction of the annular portion 23 as the wing-like portions 42 are arranged along the circumferential direction of the annular portion 23. Thus, the volume of the airflow noise in the centrifugal compressor 10 is reduced.

[Variation]

Figure 7A:
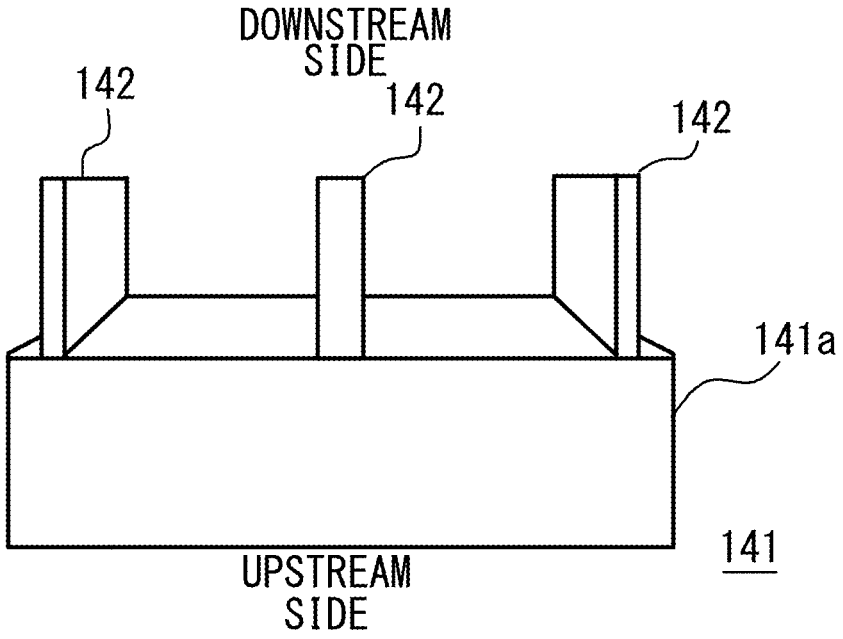
FIG. 7A is a side view of an insert ring in a variation.
Figure 7B:
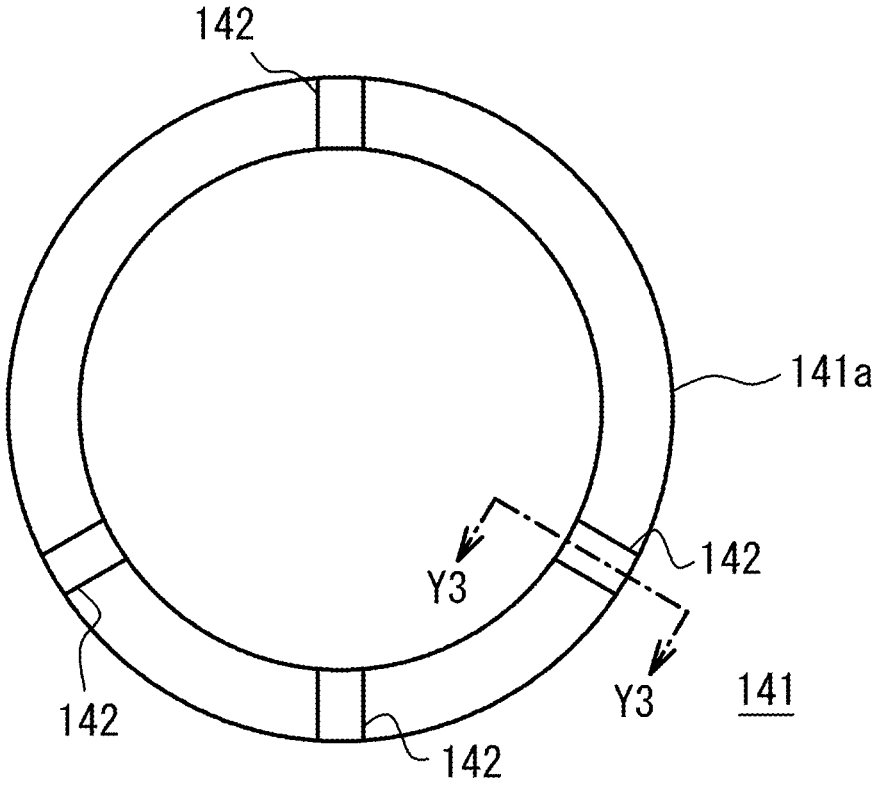
FIG. 7B is a plan view of the insert ring in the variation.
Figure 8:
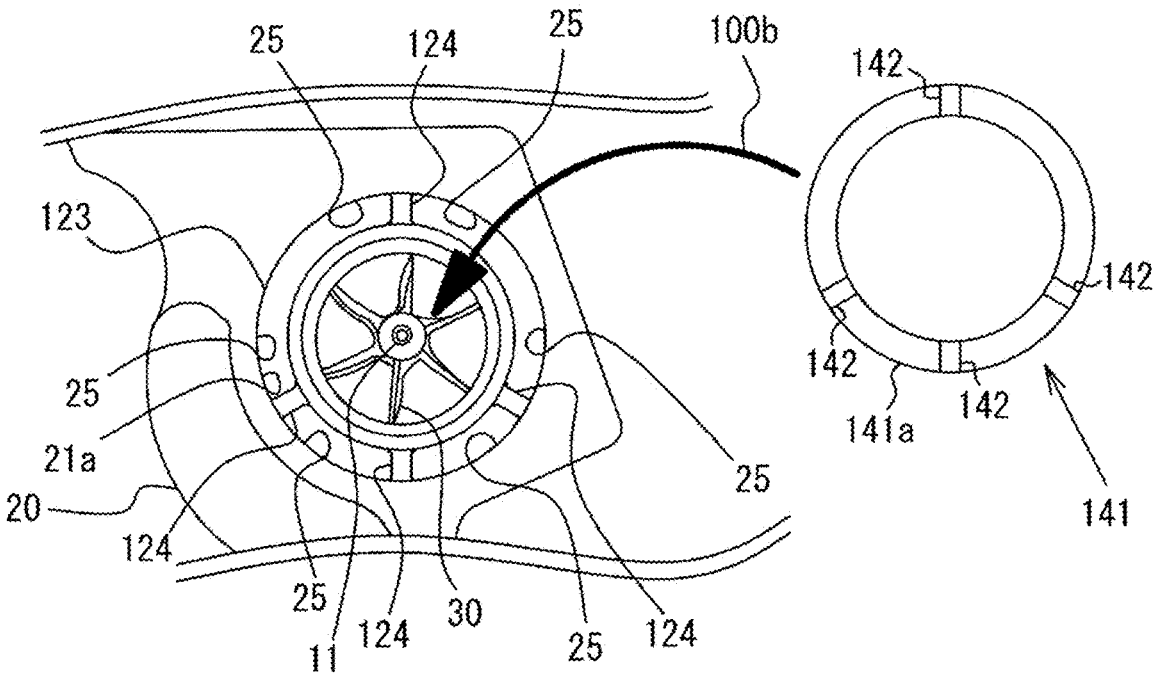
FIG. 8 is a view schematically illustrating a state in which the insert ring in the variation is mounted in the air introduction hole formed in the compressor housing.

Next, a variation will be described with reference to FIGS. 7A to 9. FIG. 7A is a side view of an insert ring 141 in a variation. FIG. 7B is a plan view of the insert ring 141 in the variation. FIG. 8 is a view schematically illustrating a state in which an insert ring is mounted in the air introduction hole 21 formed in the compressor housing 20 in the variation. Components common to the embodiments described above are given the same reference numerals in the figures. Detailed description of components denoted by the same reference numerals is omitted.

As illustrated in FIG. 8, the compressor housing 20 includes an annular portion 123 disposed inside the air introduction hole 21. The annular portion 123 is connected to the inner circumferential wall surface 21*a* of the air introduction hole 21 via spoke portions 124. A space is formed around the annular portion 23 supported by the spoke portions 124. This space forms the sub flow path 25 for circulating air.

The spoke portions 124 are provided. However, unlike the spoke portions 24 in the above-described embodiment, the spoke portions 124 are arranged at irregular intervals along the circumferential direction of the annular portion 123.

As illustrated in FIG. 7A and FIG. 7B, the insert ring 141 includes a tubular portion 141*a* and wing-like portions 142. The number of the wing-like portions 142 is the same as the number of the spoke portions 124. The positions of the wing-like portions 142 along the circumferential direction of the annular portion 123 are the same as the positions of the spoke portions 124 along the circumferential direction of the annular portion 123.

The positions of the wing-like portions 142 along the circumferential direction of the annular portion 123 and the positions of the spoke portions 124 along the circumferential direction of the annular portion 123 may be any positions. That is, the example illustrated in FIGS. 7A to 8 is merely an example of the arrangement of the wing-like portions 142 and the spoke portions 124, and other arrangement positions may be adopted.

Figure 9:
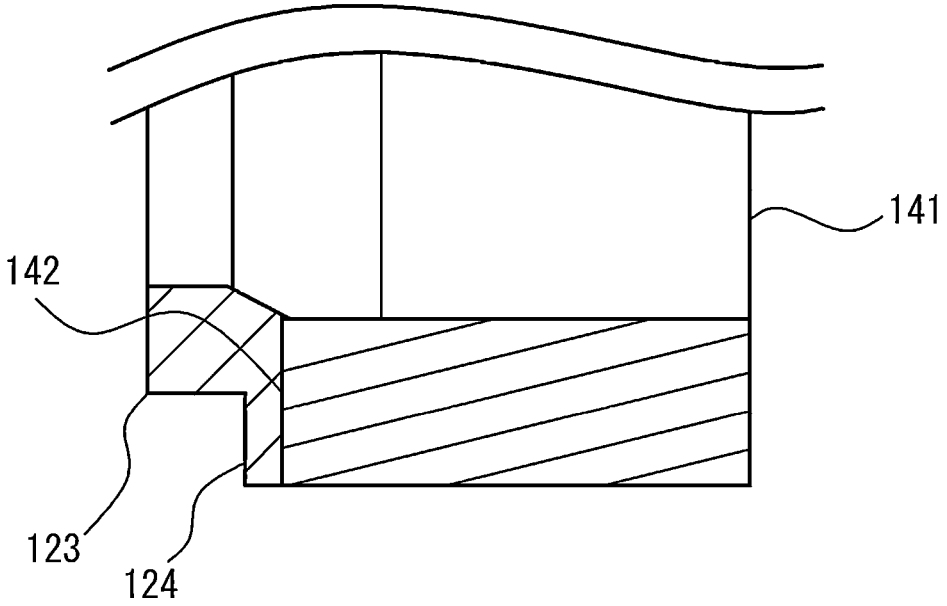
FIG. 9 is an enlarged sectional view of a connecting portion between a spoke portion and a wing-like portion in the variation taken along a line Y3-Y3 in FIG. 7B.

As illustrated in FIG. 7A and FIG. 7B, the wing-like portion 142 in the variation does not include the cutout portion 42*a* included in the wing-like portion 42 in the embodiment. The surfaces of the annular portion 123 and the spoke portions 124 facing the insert ring 141 are flush with each other. Therefore, as illustrated in FIG. 9, the wing-like portion 142 is in close contact with the annular portion 123 and the spoke portion 124.

Even in such a variation, the volume of the airflow noise in the centrifugal compressor is reduced.

Although some embodiments of the present disclosure have been described in detail, the present disclosure is not limited to the specific embodiments but may be varied or changed within the scope of the present disclosure as claimed.

What is claimed is:

1. A centrifugal compressor comprising:

a compressor housing accommodating an impeller; and a casing treatment, wherein the compressor housing includes:

an air introduction hole through which air is introduced toward the impeller;

an annular portion disposed inside the air introduction hole; and spoke portions, each of the spoke portions extending in a radial direction of the annular portion to connect an inner circumferential wall surface of the air introduction hole and the annular portion, the casing treatment includes:

a tubular portion provided on an upstream side of the annular portion in the air introduction hole in an introduction direction of the air, and wing-like portions, each of the wing-like portions extending from the tubular portion in a radial direction of the tubular portion and toward a downstream side in the introduction direction of the air;

in the casing treatment, an inside of the tubular portion forms a main flow path of the air, and each of the wing-like portions engage with the annular portion to form a sub flow path, the sub flow path branches from the main flow path and joins the main flow path again together with the annular portion and each of the spoke portions, a number of the spoke portions is equal to a number of the wing-like portions, and the spoke portions and the wing-like portions are arranged at same positions in a circumferential direction of the annular portion, respectively.

2. The centrifugal compressor according to claim 1, wherein a thickness dimension of each of the wing-like portions along the circumferential direction of the annular portion is equal to or less than a thickness dimension of each of the spoke portions along the circumferential direction of the annular portion.

3. The centrifugal compressor according to claim 1, wherein each of the wing-like portions include a cutout portion that engages with a respective one of the spoke portions.

* * * * *